US010986972B2

(12) United States Patent
Jenson

(10) Patent No.: US 10,986,972 B2
(45) Date of Patent: Apr. 27, 2021

(54) BATTERY POWERED VACUUM CLEANER

(71) Applicant: Techtronic Industries Co. Ltd., New Territories (CN)

(72) Inventor: Steven Jenson, Chagrin Falls, OH (US)

(73) Assignee: Techtronic Industries Co. Ltd., New Territories (HK)

( * ) Notice: Subject to any disclaimer, the term of this patent is extended or adjusted under 35 U.S.C. 154(b) by 298 days.

(21) Appl. No.: 15/534,602

(22) PCT Filed: Dec. 9, 2015

(86) PCT No.: PCT/US2015/064637
§ 371 (c)(1),
(2) Date: Jun. 9, 2017

(87) PCT Pub. No.: WO2016/094486
PCT Pub. Date: Jun. 16, 2016

(65) Prior Publication Data

US 2017/0360267 A1 Dec. 21, 2017

Related U.S. Application Data

(60) Provisional application No. 62/091,017, filed on Dec. 12, 2014.

(51) Int. Cl.
*A47L 9/28* (2006.01)
*A47L 11/40* (2006.01)
(Continued)

(52) U.S. Cl.
CPC ..... *A47L 9/2884* (2013.01); *A47L 5/30* (2013.01); *A47L 9/0477* (2013.01); *A47L 9/16* (2013.01); *A47L 9/325* (2013.01); *A47L 11/4005* (2013.01)

(58) Field of Classification Search
CPC ..... A47L 9/2884; A47L 11/4005; A47L 2201/00; A47L 9/1409; A47L 5/30; A47L 9/0477; A47L 9/16; A47L 9/325
See application file for complete search history.

(56) References Cited

U.S. PATENT DOCUMENTS

2004/0216266 A1* 11/2004 Conrad ..... A47L 5/28 15/412
2005/0155177 A1* 7/2005 Baer ..... A47L 5/365 15/353

(Continued)

FOREIGN PATENT DOCUMENTS

CN 1596815 A 3/2005
GB 2502132 B 11/2014

(Continued)

OTHER PUBLICATIONS

International Search Report and Written Opinion for Application PCT/US2015/064637 dated Apr. 6, 2017 (8 pages).

(Continued)

*Primary Examiner* — Andrew A Horton
(74) *Attorney, Agent, or Firm* — Michael Best & Friedrich LLP

(57) ABSTRACT

A vacuum cleaner including an airflow passage that extends from a suction inlet to an air outlet, a dirt separator, a suction source operable to generate a suction airflow that travels through the suction inlet, through the dirt separator, and through the air outlet. The vacuum further includes a battery that supplies power to the suction source to generate the suction airflow and a portion of the airflow passage is defined by the battery.

20 Claims, 5 Drawing Sheets

(51) Int. Cl.

| | |
|---|---|
| ***A47L 5/30*** | (2006.01) |
| ***A47L 9/04*** | (2006.01) |
| ***A47L 9/16*** | (2006.01) |
| ***A47L 9/32*** | (2006.01) |

(56) References Cited

U.S. PATENT DOCUMENTS

| | | | | |
|---|---|---|---|---|
| 2005/0210624 | A1 | 9/2005 | Lammers | |
| 2005/0247036 | A1* | 11/2005 | Fujiyoshi | A47L 9/1409 55/467 |
| 2009/0271943 | A1 | 11/2009 | Williamson | |
| 2013/0061417 | A1* | 3/2013 | Vanderstegen-Drake | A47L 5/30 15/319 |
| 2013/0091815 | A1 | 4/2013 | Smith | |
| 2013/0239360 | A1 | 9/2013 | Hensel | |
| 2013/0305484 | A1 | 11/2013 | Dyson et al. | |

FOREIGN PATENT DOCUMENTS

| | | | |
|---|---|---|---|
| JP | 2009089948 | A | 4/2009 |
| WO | WO-0036969 | A1 | 6/2000 |
| WO | 2004041055 | A1 | 5/2004 |
| WO | WO-2004041054 | A1 | 5/2004 |

OTHER PUBLICATIONS

Chinese Patent Office Action for Application No. 201580072512.1 dated Dec. 5, 2018, 12 pages.

Chinese Patent Office Action for related Application No. 201580072512.1 dated Aug. 5, 2019 (11 pages including English summary).

* cited by examiner

BATTERY POWERED VACUUM CLEANER

CROSS-REFERENCE TO RELATED APPLICATIONS

This application claims priority to U.S. Provisional Patent Application No. 62/091,017, filed Dec. 12, 2014, the entire contents of which are hereby incorporated by reference herein.

BACKGROUND

The present invention relates to vacuum cleaners, and more particularly to battery powered vacuum cleaners.

SUMMARY

In one embodiment, the invention provides a vacuum cleaner including an airflow passage that extends from a suction inlet to an air outlet, a dirt separator, a suction source operable to generate a suction airflow that travels through the suction inlet, through the dirt separator, and through the air outlet. The vacuum cleaner further includes a battery that supplies power to the suction source to generate the suction airflow and a portion of the airflow passage is defined by the battery.

In another embodiment the invention provides a vacuum cleaner including a base including a suction inlet, a handle pivotally coupled to the base, an air outlet, a dirt separator, a suction source operable to generate a suction airflow that travels through the suction inlet, through the dirt separator, and through the air outlet. The vacuum cleaner further includes a battery that supplies power to the suction source, the battery is coupled to the base or the handle. The vacuum cleaner further includes an airflow passage that extends from the suction inlet to the air outlet and a portion of the airflow passage between the suction inlet and the dirt separator is defined by the battery.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
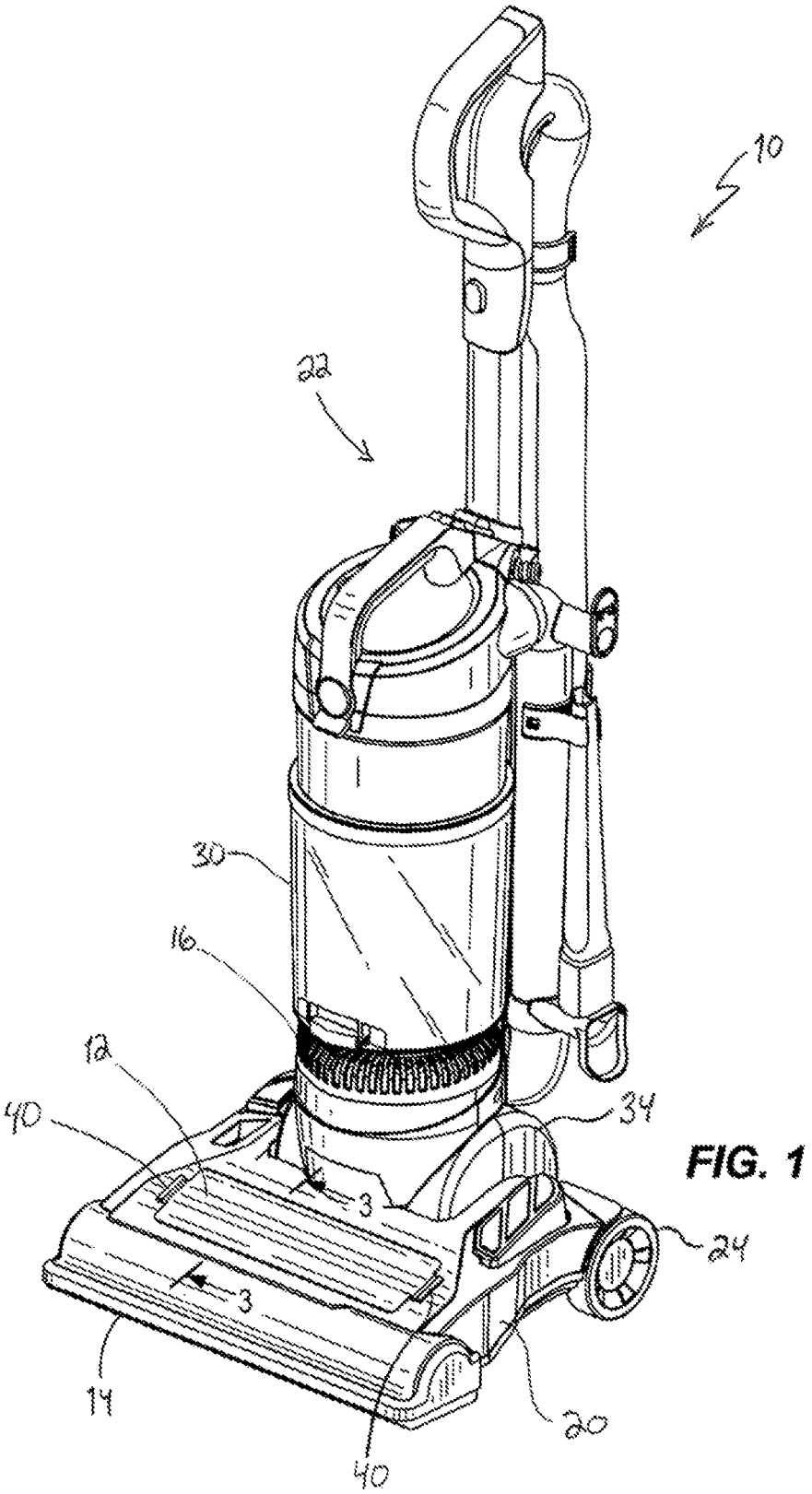
FIG. 1 is a perspective view of a vacuum cleaner according to one embodiment of the invention.

FIG. 1 illustrates a vacuum cleaner 10 according to one embodiment. As will be discussed in more detail below, referring to FIG. 2, the vacuum cleaner 10 includes a battery

12 that defines a portion of an airflow passage between a suction inlet 14 and a clean air outlet 16 of the vacuum cleaner 20. This feature allows a relatively large battery 12 to be used with the vacuum and also provides some cooling airflow for the battery 12.

Figure 2:
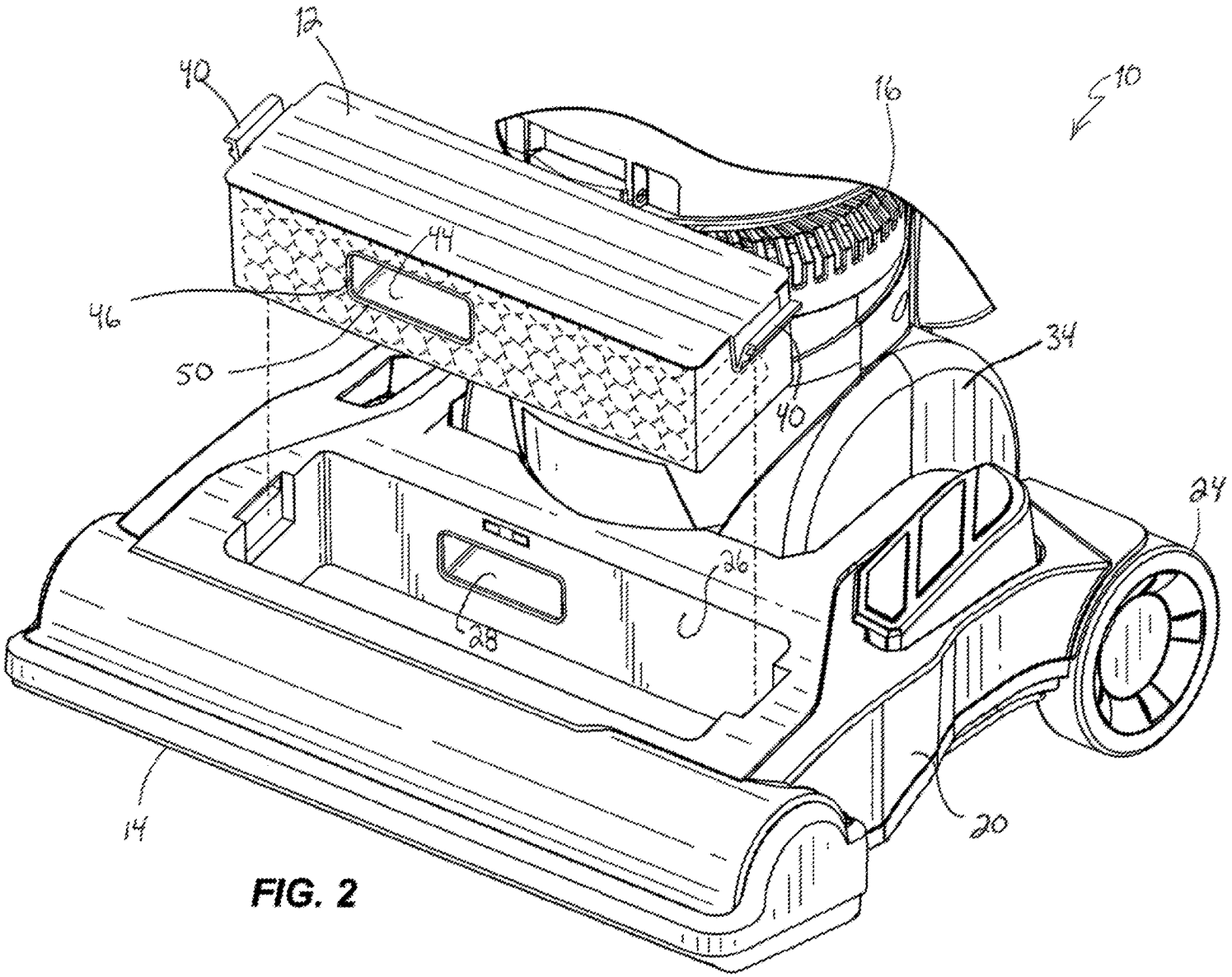
FIG. 2 illustrates a battery of the vacuum cleaner of FIG. 1 exploded from a base of the vacuum cleaner.

Referring to FIGS. 1 and 2, the illustrated vacuum cleaner 10 includes a base 20 and a handle 22 that is pivotally coupled to the base 20. Although the illustrated vacuum cleaner 10 is an upright style vacuum with the handle 22 pivotally coupled to the base 20, in other embodiments, other types and styles of vacuum cleaners can be utilized (e.g., canister, handheld, utility, etc.). Furthermore, although the illustrated vacuum cleaner is intended for dry surfaces, the vacuum cleaner can be configured for wet surfaces. Therefore, the term "vacuum cleaner" used herein should be understood to include carpet extractors, hard floor cleaners, and the like.

Figure 3:
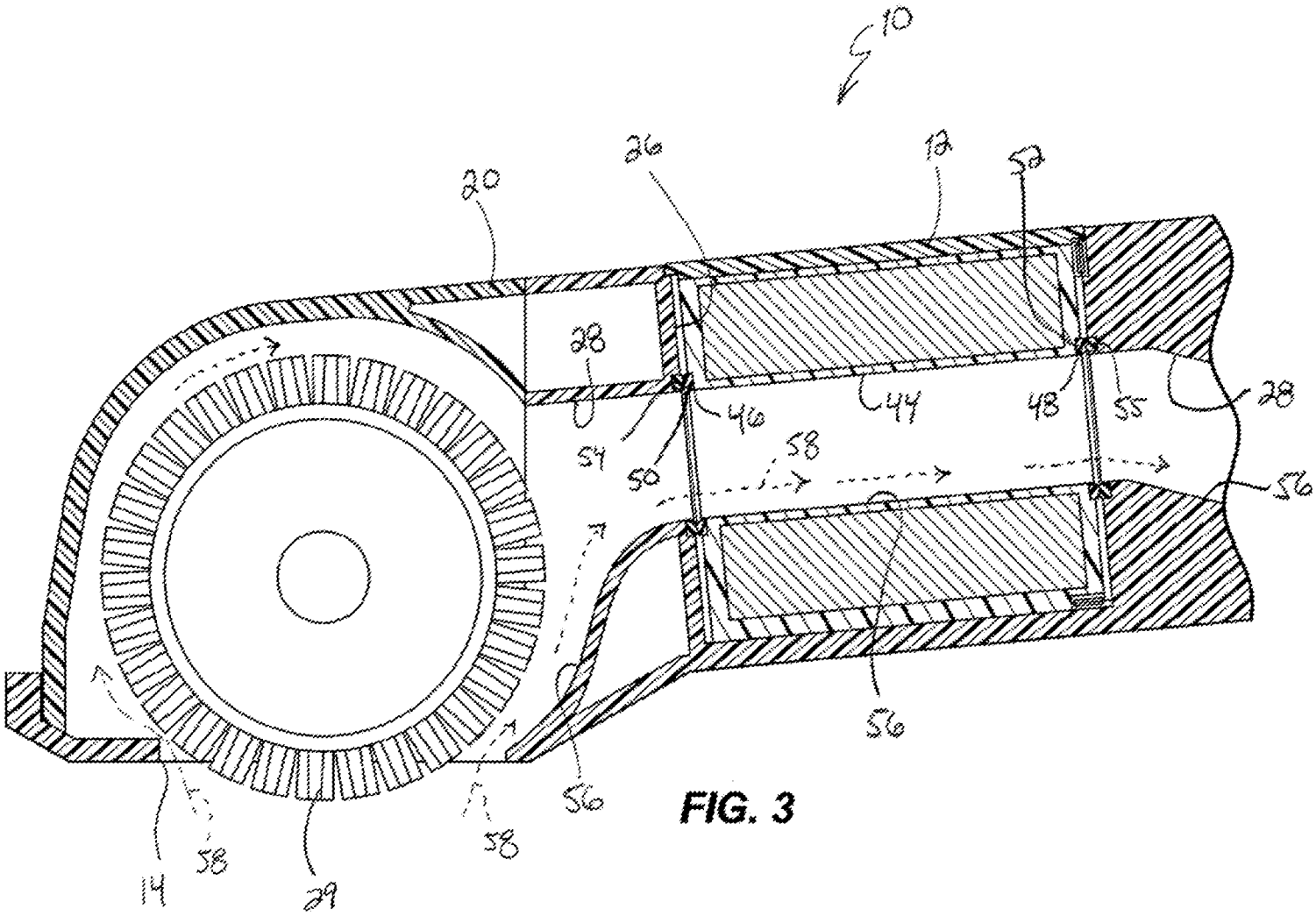
FIG. 3 is a cross-sectional view of the vacuum cleaner of FIG. 1 taken along lines 3-3 of FIG. 1.

The base 20 includes the suction inlet 14 and wheels 24, in the illustrated embodiment, that facilitate movement of the suction inlet 14 along a surface being cleaned. The base 20 further includes a recess 26 that receives the battery 12. The base 20 further includes a duct 28, which is a dirty air duct 28 in the illustrated embodiment, in fluid communication with the suction inlet 14. An agitator 29, which is a horizontal brushroll agitator in the illustrated embodiment, is located adjacent the suction inlet 14 (FIG. 3). In the illustrated embodiment, the recess 26 is located in the base 20, but in other embodiments, the recess 26 that receives the battery 12 can be located in the handle 22.

The vacuum cleaner 10 further includes a dirt separator 30 and a suction source 34. The illustrated dirt separator 30 is coupled to the handle 22 for pivotal movement with the handle 22 relative to the base 20. Also in the illustrated embodiment, the dirt separator 30 is a cyclonic dirt separator but can include other suitable types of separators (e.g., filter bag) in other embodiments. The air clean air outlet 16 is also located on the handle 22 in the illustrated embodiment. The suction source 34 includes an electric motor and a fan. The suction source 34 is powered by the battery 12 to generate a suction airflow.

The illustrated battery 12 is received in the recess 26 of the base 20 to couple the battery 12 to the base 20. Although the illustrated battery 12 is coupled to the base 20, in other embodiments, the battery 12 can be coupled to other portions of the vacuum cleaner 10, such as the handle 22. The battery 12 further includes clamps 40 that removable couple and secure the battery 12 to the base 20. The illustrated clamps 40 are just one possible type of clamp that can be used to secure the battery 12 to the base 20 and in other embodiments, other types of clamps can be used.

Referring to FIGS. 2 and 3, the battery 12 includes a duct 44 that extends through the battery 12. The duct 12 includes an inlet 46 and an outlet 48. A seal 50 surrounds the inlet 46 and a seal 52 surrounds the outlet 48. The seals 50, 52 seal with corresponding seals 54, 55 of the base 20 to inhibit airflow into the ducts 28, 44 except through the suction inlet 14. The sealing arrangement illustrated is just one possible arrangement for the seals and in other embodiments, other types and configurations of seals can be utilized. As illustrated in FIG. 3, the duct 44 of the battery 12 aligns with the duct 28 of the base 20. In one embodiment, the battery 12 is a 40 volt lithium-ion battery. In other embodiments, other types of batteries can be utilized.

In operation, the battery 12 supplies power to the suction source 34 to generate a suction airflow. The suction airflow travels through the suction inlet 14 and eventually through the clean air outlet 16 by passing through an airflow passage 56 defined by various parts of the vacuum cleaner, including the duct 44 of the battery 12. The suction airflow draws debris from a surface being cleaned and, as represented by arrows 58 in FIG. 3, the suction airflow and debris travel through the suction inlet 14 and through the duct 28 of the base 20. The suction airflow travels through the duct 44 of the battery 12 and eventually to the dirt separator 30. In the dirt separator 30, the debris is separated from the airflow and then the clean airflow is discharged from the vacuum 10 through the air outlet 16.

Figure 4:
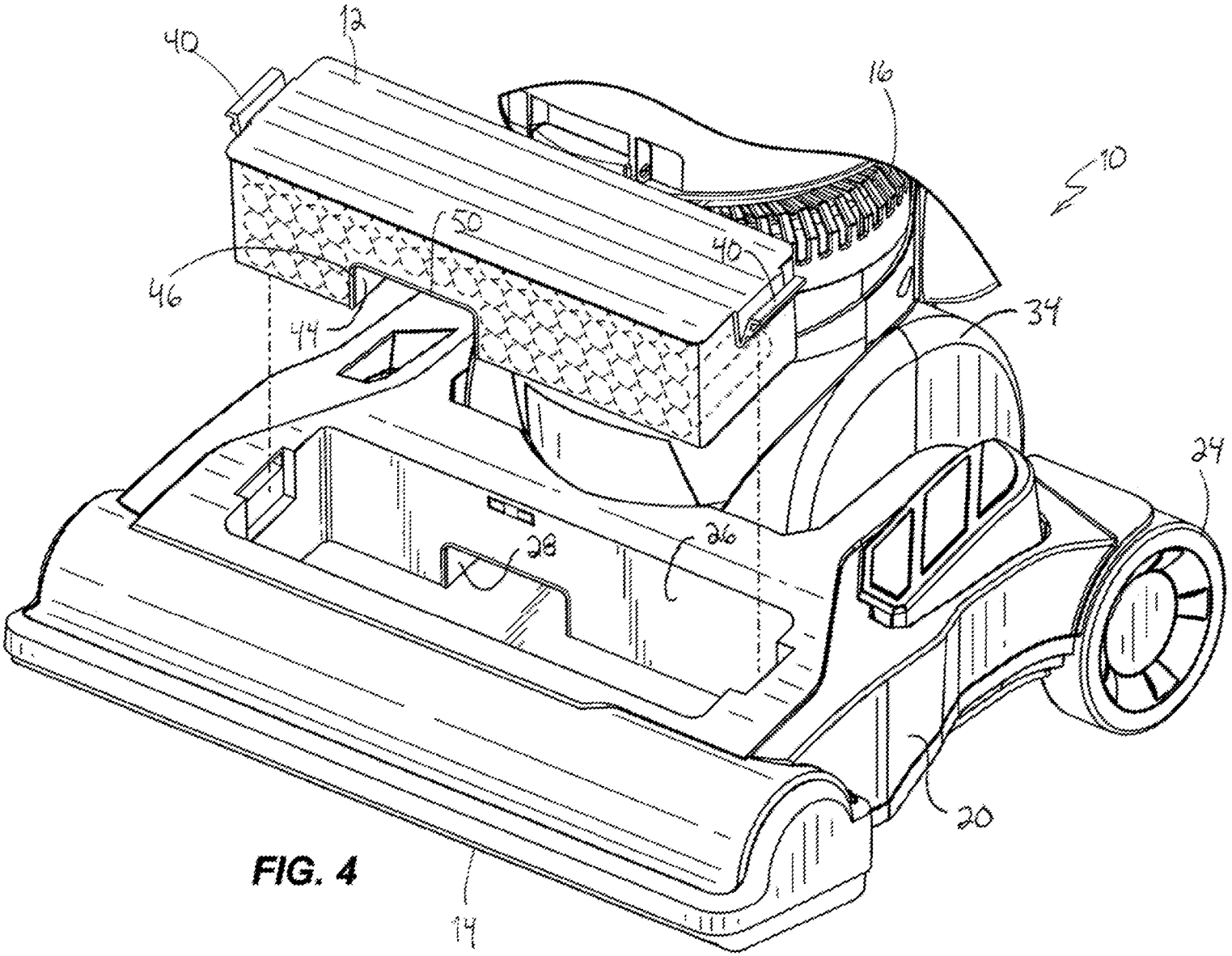
FIG. 4 is a partially exploded view of a vacuum cleaner according to another embodiment of the invention.
Figure 5:
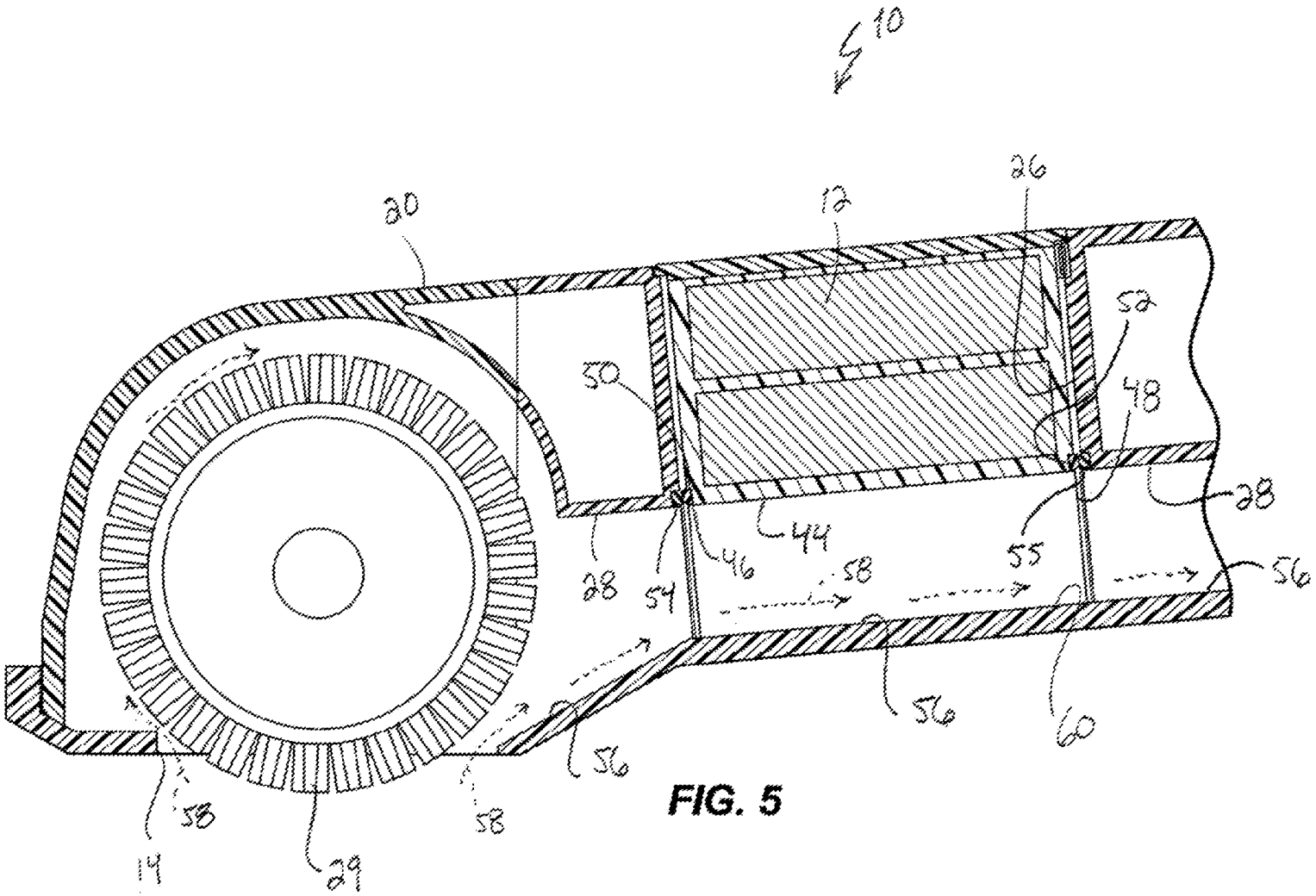
FIG. 5 is a cross-sectional view of the vacuum cleaner of FIG. 4.

In the embodiment of FIG. 3, cells of the battery 12 completely surround the duct 44 and the duct 44 is only open at the inlet 46 and the outlet 48. FIGS. 4 and 5 illustrate an alternative embodiment of the battery 12 where the duct 44 opens toward the bottom of the battery 12 such that the duct 44 and a portion 60 of the base 20 cooperate to define the airflow passage 56. Like components in the embodiment of FIGS. 4 and 5 have been given the same reference number as the embodiment of FIGS. 1-3.

Various features and advantages of the invention are set forth in the following claims.

What is claimed is:

1. A vacuum cleaner comprising:

an airflow passage that extends from a suction inlet to an air outlet;

a dirt separator;

a suction source operable to generate a suction airflow that travels through the suction inlet, through the dirt separator, and through the air outlet; and a battery that supplies power to the suction source to generate the suction airflow;

wherein a portion of the airflow passage is defined by the battery, wherein the portion of the airflow passage that is defined by the battery is located between the suction inlet and the dirt separator, such that air flows through the air flow passage defined by the battery prior to flowing through the dirt separator, and wherein the dirt separator includes a cyclonic separator, wherein the battery includes a duct that extends through the battery and the duct at least partially defines the portion of the airflow passage that is defined by the battery, further comprising a base and a handle, the base including the suction inlet and the handle pivotally coupled to the base, wherein the duct of the battery and a portion of the base cooperate to define a portion of the airflow passage.

2. The vacuum cleaner of claim 1 wherein the battery is coupled to the base such that the handle is pivotal relative to the base and the battery.

3. The vacuum cleaner of claim 2, further comprising a clamp that removably couples the battery to the base.

4. The vacuum cleaner of claim 1, wherein the base includes a recess that receives the battery.

5. The vacuum cleaner of claim 1, wherein the duct includes an inlet and an outlet, and wherein the battery includes a first seal adjacent the inlet that seals between the battery and the base and a second seal adjacent the outlet that seals between the battery and the base.

6. The vacuum cleaner of claim 1, wherein the battery includes a seal that inhibits airflow into the airflow passage.

7. The vacuum cleaner of claim 1, further comprising a clamp that secures the battery.

8. A vacuum cleaner comprising:

a base including a suction inlet;

a handle pivotally coupled to the base;

an air outlet;

a dirt separator;

a suction source operable to generate a suction airflow that travels through the suction inlet, through the dirt separator, and through the air outlet;

a battery that supplies power to the suction source, the battery coupled to the base; and an airflow passage that extends from the suction inlet to the air outlet, wherein a portion of the airflow passage positioned fluidly between the suction inlet and the dirt separator is defined by the battery, and wherein the dirt separator includes a cyclonic separator.

9. The vacuum cleaner of claim 8, further comprising a clamp that removably couples the battery to the base.

10. The vacuum cleaner of claim 8, wherein the base includes a recess that receives the battery.

11. The vacuum cleaner of claim 8, wherein the battery includes a duct that extends through the battery and the duct at least partially defines the portion of the airflow passage that is defined by the battery.

12. The vacuum cleaner of claim 11, wherein the duct of the battery and a portion of the base cooperate to define a portion of the airflow passage.

13. The vacuum cleaner of claim 11, wherein the duct includes an inlet and an outlet, and wherein the battery includes a first seal adjacent the inlet that seals between the battery and the base and a second seal adjacent the outlet that seals between the battery and the base.

14. A vacuum cleaner comprising:

a base at least partially defining an airflow passage that extends from a suction inlet to an air outlet;

a dirt separator;

a suction source operable to generate a suction airflow that travels through the suction inlet, through the dirt separator, and through the air outlet; and a battery that supplies power to the suction source to generate the suction airflow, the battery including a duct having an inlet and an outlet, the duct extending through the battery and the duct at least partially defining the portion of the airflow passage that is defined by the battery, and the battery including a first seal adjacent the inlet that seals between the battery and the base and a second seal adjacent the outlet that seals between the battery and the base;

wherein a portion of the airflow passage is defined by the battery, wherein the portion of the airflow passage that is defined by the battery is located between the suction inlet and the dirt separator, such that air flows through the air flow passage defined by the battery prior to flowing through the dirt separator.

15. A vacuum cleaner comprising:

an airflow passage that extends from a suction inlet to an air outlet;

a dirt separator;

a suction source operable to generate a suction airflow that travels through the suction inlet, through the dirt separator, and through the air outlet; and a battery that supplies power to the suction source to generate the suction airflow;

wherein a portion of the airflow passage is defined by the battery, wherein the portion of the airflow passage that is defined by the battery is located between the suction inlet and the dirt separator, such that air flows through the air flow passage defined by the battery prior to flowing through the dirt separator where the dirt separator is the first device along the airflow passage configured to separate debris from the suction airflow.

16. The vacuum cleaner of claim 15, wherein the battery includes a duct that extends through the battery and the duct at least partially defines the portion of the airflow passage that is defined by the battery, further comprising a base and a handle, the base including the suction inlet and the handle pivotally coupled to the base, wherein the duct of the battery and a portion of the base cooperate to define a portion of the airflow passage.

17. The vacuum cleaner of claim 16, wherein the battery is coupled to the base such that the handle is pivotal relative to the base and the battery.

18. The vacuum cleaner of claim 17, wherein the base includes a recess that receives the battery.

19. The vacuum cleaner of claim 15, wherein the battery includes a duct that extends through the battery and the duct at least partially defines the portion of the airflow passage that is defined by the battery, wherein the duct of the battery and a portion of the base cooperate to define a portion of the airflow passage.

20. The vacuum cleaner of claim 15, further comprising a clamp that removably couples the battery to the base.

* * * * *